United States Patent [19]

Ritzow et al.

[11] 3,967,732

[45] July 6, 1976

[54] SHIPPING WRAPPER FOR AQUARIUM

[76] Inventors: Gerald R. Ritzow, 6300 Parkview Road, Greendale, Wis. 53129; Roger C. Ritzow, 553 W23581 Big Bend Road, Waukesha, Wis. 53186

[22] Filed: Aug. 1, 1975

[21] Appl. No.: 601,061

[52] U.S. Cl. ..... 206/521; 229/40

[51] Int. Cl.[2] ..... B65D 81/14

[58] Field of Search ..... 119/5; 206/320, 454, 206/491, 493, 521, 527; 220/82 R; 229/14 C, 40, 87 R

[56] References Cited

UNITED STATES PATENTS

| | | | |
|---|---|---|---|
| 3,622,066 | 11/1971 | Saferstein | 206/454 X |
| 3,718,275 | 2/1973 | Willinger | 229/40 X |
| 3,780,933 | 12/1973 | Freeman | 206/521 X |

*Primary Examiner*—Steven E. Lipman
*Attorney, Agent, or Firm*—Michael, Best & Friedrich

[57] ABSTRACT

A shipping wrapper for an aquarium, the aquarium having a bottom, a front wall, a rear wall, and end walls interconnected to form an enclosure, the front, rear and end walls having an overlapping rim on the top edges. The wrapper has a bottom panel, end wall panels, and end wall rim panels hingedly connected together along fold lines and positioned generally adjacent corresponding portions of the aquarium. End flaps are hingedly connected to the end wall rim panels, the end flaps each having outwardly extending end tabs with locking edges. The end flaps are folded into the aquarium so that the locking edges of the end tabs are captured beneath the overlapping rim on the top edges of the front and rear walls of the aquarium.

5 Claims, 5 Drawing Figures

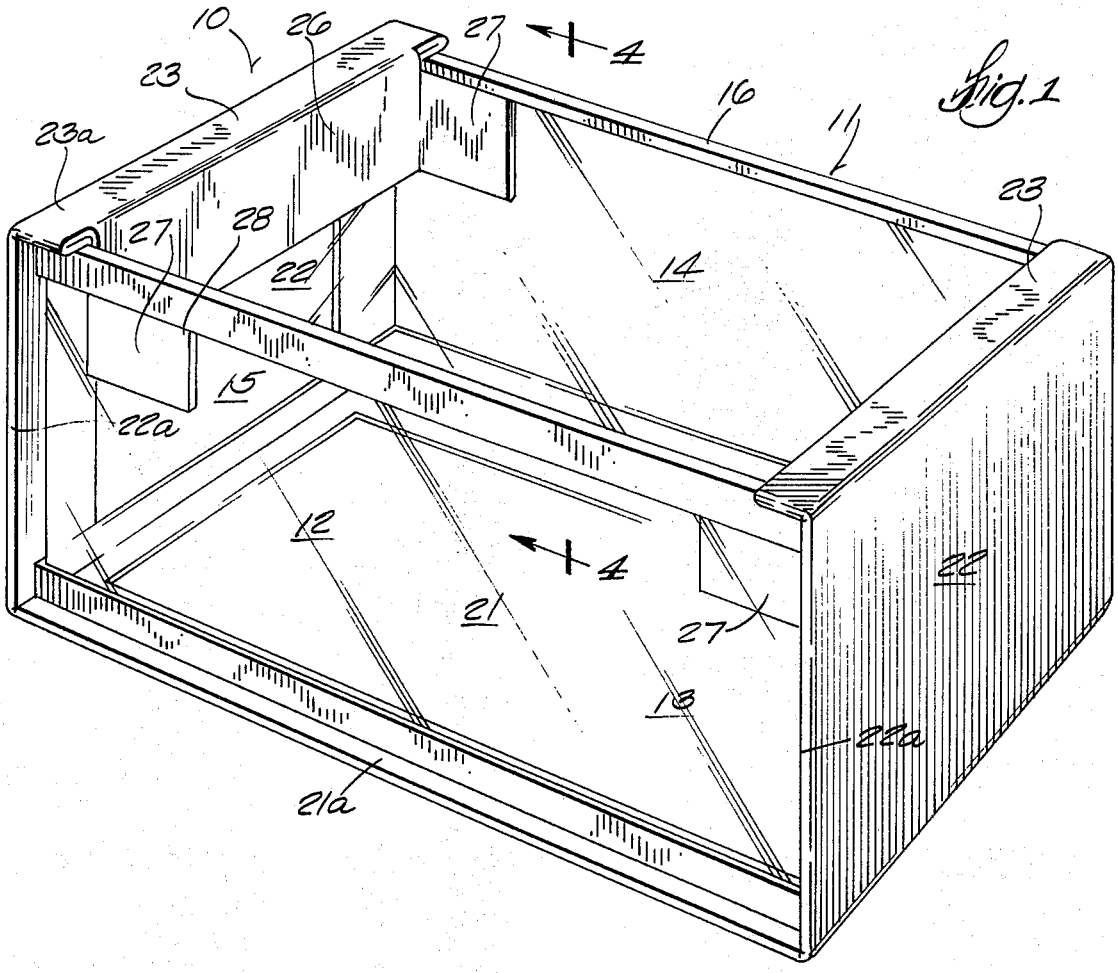
Fig. 1
Fig. 2
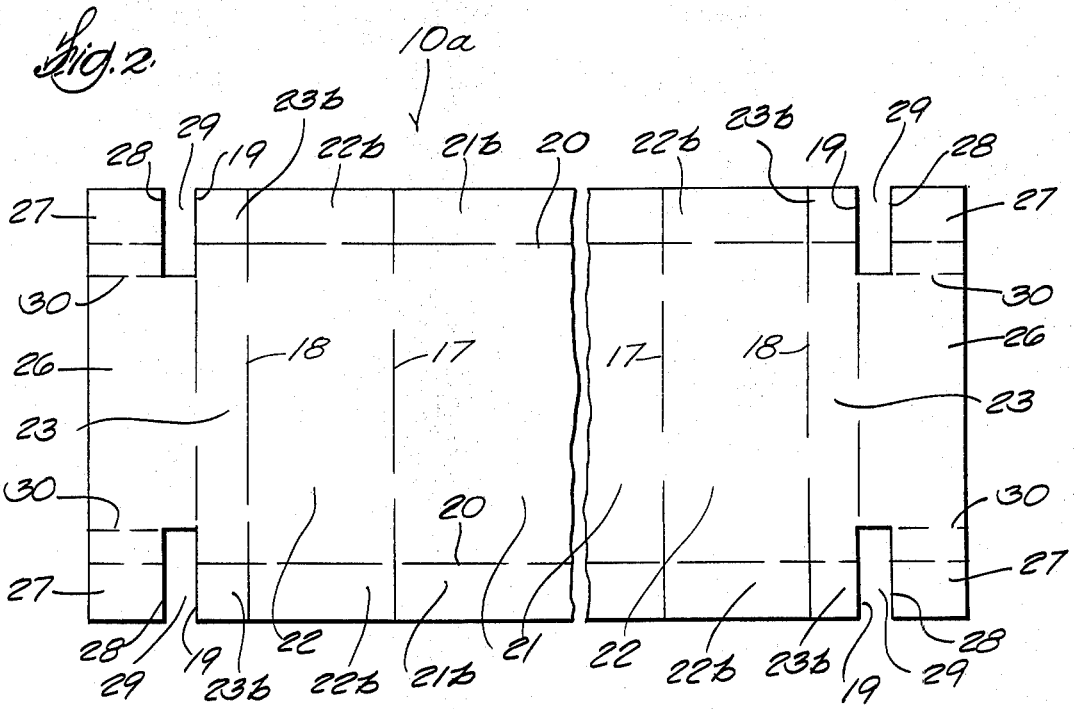

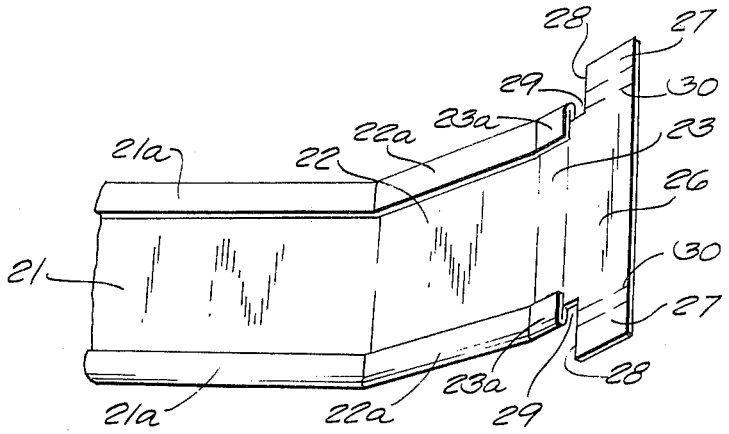
Fig. 3
Fig. 4
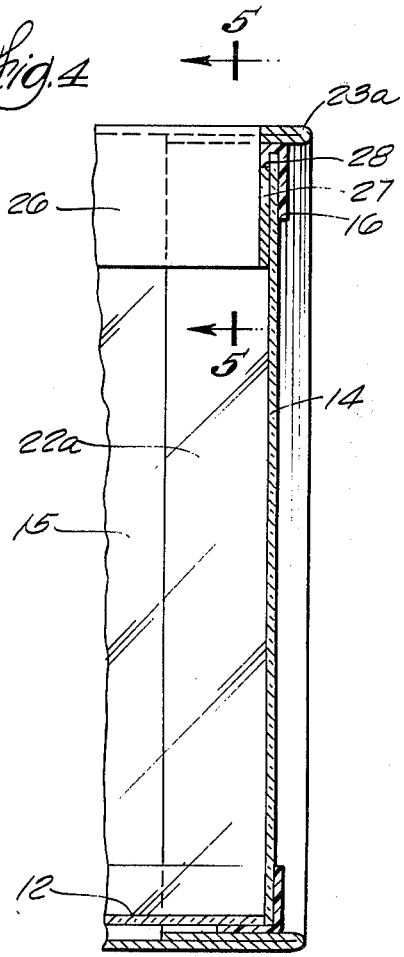
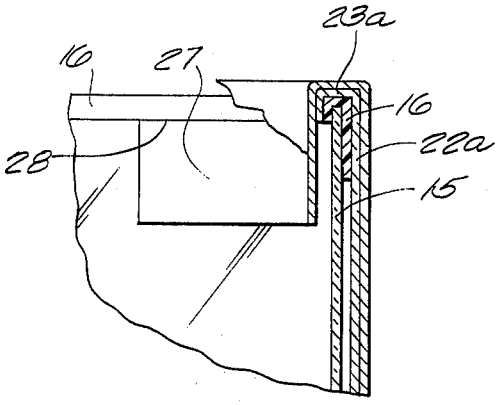
Fig. 5

SHIPPING WRAPPER FOR AQUARIUM

BACKGROUND OF THE INVENTION

1. Field of the Invention

The present invention relates generally to protective cartons for aquarium shipping and display purposes and more particularly to a shipping wrapper for an aquarium having an overlapping rim on the top edges.

2. Description of the Prior Art

Glass aquariums with no additional supporting structure at the corners are increasingly popular due to the unobstructed view they provide. Supplying such aquariums with a protective wrapper for shipping and display purposes is well known in the art, as is demonstrated by U.S. Pat. No. 3,718,275. The above reference patent teaches the use of an extended cardboard edge reinforced with internal corrugated ribs to protect the exposed corner edges of the aquarium. The protective wrapper is secured to the aquarium by press fitting portions of the reinforced edges of the end flaps between the front and rear walls of the aquarium. There is a continuing need in the art to provide shipping and display wrappers which provide more substantial protection for the exposed corner edges of a glass aquarium. Further, there is need to provide a self-securing protective wrapper that can be attached to the aquarium without putting an appreciable stress on the glass corner joints.

SUMMARY OF THE INVENTION

The present invention provides a shipping wrapper for an aquarium, the aquarium having a bottom, a front wall, a rear wall, and end walls interconnected to form an enclosure, the front, rear, and end walls having an overlapping rim on the top edges. The wrapper, formed from a unitary corrugated cardboard blank, has a bottom panel, end wall panels, and end wall rim panels with overlapped side edges. The bottom, end wall, and end wall rim panels are hingedly connected together and are folded into a position generally adjacent corresponding portions of the aquarium. The overlapped side edges of the wrapper panels project laterally beyond the width of the aquarium providing substantial protection against impact to the exposed corner edges of the aquarium. End flaps having a width less than the distance between the front and rear walls of the aquarium are hingedly connected to the end rim panels. Each end flap preferably has outwardly extending end tabs with locking edges defined by lateral slots extending inwardly adjacent the end rim panels, the slots having a width greater than the distance the overlapping rim extends into the aquarium. The shipping wrapper is secured in place without putting an appreciable stress on the aquarium glass corner joints by folding the end flaps and end tabs downwardly into the aquarium so that the locking edges of the end tabs are captured underneath the overlapping rim of the front and rear walls of the aquarium.

It is an object of the present invention to provide a novel shipping wrapper which provides substantial protection for exposed corner edges of a glass aquarium, the aquarium having an overlapping rim on the top edges.

A further object of the present invention is to provide a novel, simple means of securing the shipping wrapper utilizing the overlapping rim of the aquarium.

A still further object of the present invention is to provide a novel securing means for the shipping wrapper which eliminates putting any appreciable stress on the corner joints of the aquarium.

BRIEF DESCRIPTION OF THE DRAWINGS

FIG. 1 is a perspective view of the shipping wrapper of this invention installed on an aquarium having an overlapping rim on the top edges.

FIG. 2 is a plan view of a suitably cut and scored blank from which the shipping wrapper of FIG. 1 is formed.

FIG. 3 is a fragmentary perspective view of the blank of FIG. 2 shown in partially folded condition.

FIG. 4 is a fragmentary sectional view taken along line 4—4 of FIG. 1.

FIG. 5 is a fragmentary sectional view taken along line 5—5 of FIG. 4.

DESCRIPTION OF THE PREFERRED EMBODIMENT

Referring more particularly to the drawings wherein like numerals refer to like parts throughout the several views, FIG. 1 shows a shipping wrapper generally denoted 10, installed on the aquarium, generally denoted 11. The Aquarium 11 has a bottom 12, a front wall 13, a rear wall 14, and end walls 15, interconnected to form an enclosure. The front, rear and end walls of the aquarium have an overlapping rim 16. The overlapping rim 16 has a width at least as great as the thickness of the blank from which the wrapper is constructed as will be described below.

The shipping wrapper preferably is formed from a suitably cut and scored corrugated cardboard blank, generally denoted 10*a*, as shown in FIG. 2. The blank 10*a* has a first pair of lateral fold lines 17, a second pair of lateral fold lines 18 located outside the first pair 17, and a third pair of lateral fold lines 19 located outside the second pair 18. The blank 10*a* has a pair of transverse fold lines 20, extending essentially end to end, running perpendicular to and intersecting the first, second and third pair of lateral fold lines 17, 18, and 19, respectively. A pair of short fold lines 30, located at each end of the blank, extend parallel and inside of the transverse fold lines 20 to an intersection with one of the lateral fold lines 19. Lateral slots 29 cut out of the side edges of the blank 10*a* at each end, extend inwardly adjacent and coincident with lateral fold lines 19 to an intersection with the short fold lines 30.

The wrapper 10 formed from the blank 10*a* has a bottom panel 21, end wall panels 22, and end wall rim panels 23, having the lateral extent of their side edges defined by the pair of transverse fold lines 20. The hingedly connected interior edges of the bottom, end wall, and end wall rim panels 21, 22, and 23 are defined by the lateral fold lines 17, 17 and 18, 18 and 19, respectively. Referring to FIGS. 2 and 3, the bottom panel 21, end wall panels 22, and end wall rim panels 23 preferably each have inwardly overlapped side edges denoted by the reference characters 21*a*, 22*a*, and 23*a*, respectively. The overlapped side edges are formed by folding corresponding outer portions of the blank 21*b*, 22*b* and 23*b*, outside the transverse fold lines 20 inwardly, approximately 180°. The width between the transverse fold lines 20 defining the lateral extent of the overlapped side edges preferably is greater than the width of the bottom and end walls of the aquarium to protect the corner edges of the aquarium against external impact, as will be discussed in more detail below.

Referring to FIG. 1, the aquarium 11 is placed on the bottom panel 21 of the wrapper. The end wall panels 22 and end wall rim panels 23 are folded and positioned generally adjacent to corresponding portions of the aquarium. The end wall panels 22 are positioned relatively parallel to the end walls 15 of the aquarium and the end wall rim panels 23 are positioned above and relatively parallel to the overlapping rim 16 of the end walls of the aquarium. The aquarium 11 is positioned and the wrapper panels are preferably dimensioned so that the overlapping side edges 21*a*, 22*a*, and 23*a* project laterally beyond the side edges of the bottom and end walls of the aquarium. It should be readily understood by those skilled in the art that the double thickness of the overlapped side edges projecting beyond the side edges of the aquarium provides substantial protection against impact for the glass corner joints formed by the junction of the front and rear walls, 13 and 14, with the end walls 15 of the aquarium.

Referring to FIGS. 1–3, each of the end rim panels 23 has an end flap 26 hingedly connected along the lateral fold lines 19. The end flaps 26 have outer portions preferably each having outwardly extending end tabs 27, hingedly connected along short fold lines 30 extending parallel to and inside of the transverse fold lines 20. The end tabs 27 have locking edges 28, defined by lateral slots 29 cut out of the blank 10*a*, extending inwardly to the short fold lines 30. The width of the end flaps 26 defined by the lateral distance between the short fold lines 30, is less than the distance between the front and rear walls, 13 and 14 of the aquarium 11. The lateral slots 29, defining the distance of the end tab locking edges 28 from the end wall rim panels 23 have a width slightly greater than the distance the overlapping rim 16 extends downwardly into the aquarium 11.

After the bottom, end wall and end wall rim panels of the aquarium have been folded and positioned adjacent to corresponding portions of the aquarium, as was described earlier, the end flaps 26 and end tabs 27 are folded into the aquarium to provide a self-locking means of attaching the shipping wrapper to the aquarium, as will be described in detail below.

Referring to FIGS. 1–5, since the width of the end flaps 26 is less than the distance between the front and rear walls of the aquarium, the end flaps 26 can be easily folded downwardly into the aquarium. At the same time, the outwardly extending end tabs 27 are folded generally perpendicular to the end flaps 26 along the short fold lines 30 by the shearing force resulting from the contact with the overlapping rim 16 of the front and rear walls of the aquarium. When the locking edges 28 of the end tabs 27 are folded downwardly beyond the overlapping rim 16 extending into the aquarium, the resilient force of the folded cardboard causes the end tabs 27 to snap against the front and rear walls of the aquarium. The locking edges 28 of the end tabs 27 are captured beneath the overlapping rim 16 of the front and rear walls thus securely attaching the shipping wrapper to the aquarium. The wrapper can be removed from the aquarium by pulling the end tabs 27 and locking edges 28 inwardly from beneath the overlapping rim 16 so that the end flaps 26 can be lifted out of the aquarium.

It will be appreciated by those skilled in the art that the manner in which the end tabs with locking edges secure the wrapper to the aquarium eliminates putting any appreciable stress on the corner joints of the aquarium.

It is to be understood that the invention is not confined to the particular construction and arrangement of parts herein illustrated and described, but embraces all such modified forms thereof, as come within the scope of the following claims.

We claim:

1. A protective wrapper for an aquarium, the aquarium having a bottom, a front wall, a rear wall, and end walls interconnected to form an enclosure, the front, rear, and end walls having an overlapping rim on the top edges, said wrapper comprising:

a. a bottom panel, end wall panels, and end wall rim panels, said panels being hingedly connected along fold lines and positioned generally adjacent corresponding portions of the aquarium, b. end flaps hingedly connected to said end wall rim panels, said end flaps each having outwardly extending end tabs with locking edges, said end flaps and end tabs being folded into the aquarium so that said locking edges are captured beneath the overlapping rim on the top edges of the front and rear walls of the aquarium.

2. A protective wrapper for an aquarium as specified in claim 1 wherein: said bottom panel, end wall panels, and end wall rim panels each have inwardly overlapped side edges.

3. A protective wrapper for an aquarium as specified in claim 2 wherein: said overlapped side edges project laterally beyond the side edges of the bottom and end walls of the aquarium.

4. A protective wrapper for an aquarium, the aquarium having a bottom, a front wall, a rear wall, and end walls interconnected to form an enclosure, the front, rear and end walls having an overlapping rim on the top edges, said wrapper comprising:

a. a bottom panel, end wall panels, and end wall rim panels, each panel having inwardly overlapped side edges, said panels being hingedly connected together along fold lines and positioned generally adjacent corresponding portions of the aquarium, said overlapped side edges projecting laterally beyond the side edges of the bottom and end walls of the aquarium, b. end flaps hingedly connected to said end wall rim panels, said end flaps being folded into the aquarium enclosure so that outer portions of said end flaps are captured beneath the overlapping rim on the top edges of the front and rear walls of the aquarium.

5. A protective wrapper for an aquarium, the aquarium having a bottom, a front wall, a rear wall, and end walls interconnected to form an enclosure, the front, rear and end walls having an overlapping rim on the top edges, said wrapper comprising:

a. a bottom panel, end wall panels, and end wall rim panels, each panel having inwardly overlapped side edges, said panels being hingedly connected together along fold lines and positioned generally adjacent corresponding portions of the aquarium, said overlapped side edges projecting laterally beyond the side edges of the bottom and end walls of the aquarium, b. end flaps hingedly connected to said end wall rim panels, said end flaps each having outwardly extending end tabs with locking edges defined by lateral slots extending inwardly adjacent said end rim panels, said end flaps and end tabs being folded into the aquarium enclosure, said end tabs being folded generally perpendicular to said end flaps, said end tabs being positioned adjacent the front and rear walls of the aquarium so that said locking edges of said end tabs are captured beneath the overlapping rim on the top edges of the front and rear walls of the aquarium.

* * * * *